US006679166B2

(12) United States Patent
Nakamura et al.

(10) Patent No.: US 6,679,166 B2
(45) Date of Patent: Jan. 20, 2004

(54) STENCIL PLATE HAVING INDEPENDENT DOT PERFORATIONS

(75) Inventors: Jun Nakamura, Ibaraki-ken (JP); Shoichi Ikejima, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/259,401

(22) Filed: Sep. 30, 2002

(65) Prior Publication Data

US 2003/0061949 A1 Apr. 3, 2003

Related U.S. Application Data

(62) Division of application No. 09/858,911, filed on May 17, 2001, now Pat. No. 6,536,338.

(30) Foreign Application Priority Data

May 19, 2000 (JP) ..... 2000-148950
Apr. 24, 2001 (JP) ..... 2001-126014

(51) Int. Cl.[7] ..... B41N 1/24
(52) U.S. Cl. ..... 101/128.21
(58) Field of Search ..... 101/127, 128.21, 101/128.4; 400/120.09, 120.13; 347/188, 193, 221; 428/131, 137, 195

(56) References Cited

U.S. PATENT DOCUMENTS 5,243,906 A 9/1993 Okusawa
5,384,585 A 1/1995 Okumura
5,522,313 A 6/1996 Okusawa
5,559,546 A 9/1996 Sato
5,617,787 A 4/1997 Takita et al.
6,130,697 A 10/2000 Yokoyama et al.
6,532,867 B2 * 3/2003 Nakamura et al. ..... 101/128.21
2002/0015821 A1 2/2002 Ohshima et al.
2002/0018874 A1 2/2002 Nakamura et al.
2002/0028625 A1 3/2002 Nakamura et al.

FOREIGN PATENT DOCUMENTS

JP 06-320700 11/1994

* cited by examiner

*Primary Examiner*—Stephen R. Funk
(74) *Attorney, Agent, or Firm*—Fitch, Even, Tabin & Flannery

(57) ABSTRACT

In a method and apparatus for perforating a heat sensitive stencil sheet having a heat shrinkable film, the film is selectively heated with a heating device to form independent dot perforations corresponding to an image, and the heating device is controlled to ensure that the perforations satisfy the following formula (1):

$$p \geqq d+(\sqrt{2})f \quad (1)$$

where p denotes a scanning pitch in a main scanning direction or a sub scanning direction; d denotes an inner diameter of a perforation in the same direction as p; and f denotes a width of a rim of said perforation at a portion that is not merged with any rims of its adjacent perforations. Irregularity of perforation configuration is decreased, size of perforations is kept adequate, and the heating device does not have to be heated to a high temperature.

2 Claims, 6 Drawing Sheets

STENCIL PLATE HAVING INDEPENDENT DOT PERFORATIONS

CROSS-REFERENCED APPLICATIONS

This application is a divisional application of U.S. Application 09/858,911, filed May 17, 2001, now U.S. Pat. No. 6,536,338, which is hereby incorporated herein by reference in its entirety.

BACKGROUND OF THE INVENTION

1. Field of the Invention

This invention relates to a stencil plate making method and apparatus, in which a heat shrinkable film of a heat sensitive stencil sheet is perforated with a heating device such as a thermal head or laser beam, and also relates to a stencil plate produced by the method or apparatus. This invention particularly relates to a stencil plate making method and apparatus and a stencil plate, in which properly sized perforations with less irregularity are formed without requiring any severe temperature condition in the heating device.

2. Description of Related Art Including Information Disclosed Under 37 CFR 1.97 and 1.98

The heat sensitive stencil sheet has a thermoplastic resin film (hereinafter also called just "film") which has a nature that perforations for penetration of ink can be formed by heating with a heating device such as a thermal head or laser. When the stencil sheet is used for printing, ink passes through the perforations and is transferred onto paper. Various materials are proposed hitherto for the film. For example, JP-A-41-7623 proposes polypropylene, polyamides, polyethylene, and vinyl chloride vinylidene chloride copolymers; JP-A-47-1184 proposes propylene copolymers; JP-A-47-1185 proposes chlorinated polyvinyl chloride; JP-A-47-1186 proposes high crystalline polyvinyl chloride; JP-A-49-6566 proposes propylene-α-olefin copolymers; JP-A-49-10860 proposes ethylene-vinyl acetate copolymer; JP-A-51-2512 proposes acrylonitrile resins, JP-A-51-2513 proposes polyethylene terephthalate; Japanese Patent No. 1,669,893 proposes polyvinylidene fluoride; and Japanese Patent No. 2,030,681 proposes polyethylene naphthalate copolymers. Among them, films that are presently used for heat sensitive stencil sheets on the market are heat shrinkable films obtained by biaxially stretching a polyethylene terephthalate film or vinylidene chloride copolymer film, mainly for reasons of perforation sensitivity (i.e., performance to give sufficiently large perforations with small quantity of heat) and machine suitability (i.e., unlikelihood to cause wrinkling, loosening, elongation and deformation when the stencil sheet is produced into a stencil plate and used for printing). Especially for integral stencil printing machines which can automatically produce stencil plates and perform printing, the polyethylene terephthalate film is mainly used.

Alternatively, for forming perforations by means of heat, a film obtained by casting a resin with a low melting point may be used in place of the stretched heat shrinkable film. For example, Japanese Patent No. 1,668,117 and JP-A-62-173296 propose films obtained by casting a synthetic resin solution or emulsion, and JP-A-4-78590 proposes a cast thermoplastic resin film containing a silicone oil. In case of the cast film, it is not thermally shrunken, but since it is made of a resin low in melting point, it can be molten at heated portions to form perforations (hereinafter this film is called "hot-melt film").

However, at present, the hot-melt film is not practically used on the market as a heat sensitive stencil sheet. The main reasons are considered to be low perforation sensitivity, perforation configuration irregularity and low mechanical strength for printing use.

Heat shrinkable films of the heat sensitive stencil sheets currently used on the market for stencil printing machines are about 1.5 to 3 μm in thickness, and encounter no difficulty in stable forming and lamination, in contrary to hot-melt films of 10 μm or less in thickness as disclosed in the Japanese Patent No. 1,668,117 and the like.

In terms of behavior of perforation or migration of molten resins, the hot-melt film relies only on surface tension while the heat shrinkable film relies on heat shrinkage stress which is sufficiently larger than the surface tension. Therefore, the heat shrinkable film has such a higher sensitivity as to allow sufficiently large perforations to be obtained with a smaller heat quantity than the hot-melt film with the same thickness.

The heat shrinkage stress of the heat shrinkable film clearly depends on a temperature, and thus perforations can be obtained faithfully to a temperature pattern formed on the film, for example, by the heating elements of a thermal head. On the other hand, in case where a hot-melt film is heated and perforated due to surface tension, the temperature pattern of heating elements cannot be accurately reflected by the perforation configuration. The reason is that when resins lowered in viscosity due to melting migrate in accordance with surface tension, it does not always migrate toward low temperature portions far away from the center of each heating element, but can be concentrated near fibers of substrates or can flow irregularly due to a shear caused by its motion relative to the heating element. Therefore, even if a heat sensitive stencil sheet using a hot-melt film is processed into a stencil plate with an opening ratio suitable for printing conditions, uniform perforations are hardly obtained. That is, microscopically, large perforations and small perforations exist together, and it is hard to obtain uniform density, for example, in a solid printed portion of an image.

Furthermore, though the hot-melt films are composed of resins of a low melting point, they must be heated by heating elements to a temperature much higher than that for the heat shrinkable film, in order to sufficiently induce the migration of the resins with surface tension in very small areas (e.g., pixel density of 300 to 600 dpi) and in a short time (e.g., sub scanning period ranging from 2 to 4 ins) that are ordinary stencil plate making conditions of stencil plate making devices installed in current stencil printing machines. This causes the heating elements to be deteriorated due to overheating.

Moreover, during printing, the heat sensitive stencil sheet is stressed due to shear between itself and printing paper in the rotating direction of printing drum. A heat sensitive stencil sheet having a cast hot-melt film is generally lower in elastic modulus and rupture strength than a heat sensitive stencil sheet having a stretched heat shrinkable film. Therefore, a heat sensitive stencil sheet having a hot-melt film is more likely to cause deformation of printed images and, as the case may be, more likely to be broken to cause stained images, compared with a heat sensitive stencil sheet having a heat shrinkable film.

For the above reasons, it can be said that heat shrinkable films are and will be mainly used as films for heat sensitive stencil sheets. Therefore, the discussion concerning heat sensitive stencil sheets is hereinafter limited to the heat sensitive stencil sheets using a heat shrinkable film.

The heat sensitive stencil sheet is usually prepared by laminating the above-mentioned film on a porous substrate in order to impart a strength necessary for avoiding elongation, wrinkling (which distorts printed image) and breaking (which stains printed images) due to forces acting when the stencil sheet is mounted to a printing machine and used for printing. The porous substrate provides a heat sensitive stencil sheet with a strength, and allows ink to penetrate through perforations after the stencil sheet has been processed into a stencil plate. It is known that materials for the porous substrate include (1) so-called Japanese paper prepared from natural fibers such as Broussonetia Kazinoki, Edgeworthia chrysantha and Manila hemp, (2) paper-like sheets prepared from regenerated or synthetic fibers of rayon, vinylon, polyester, nylon, etc., (3) mixed paper prepared by mixing the natural fibers of (1) and the regenerated or synthetic fibers of (2), and (4) so-called polyester paper prepared by hot-calendering a thin paper prepared from a mixture of polyester fibers with non-stretched polyester fibers serving as binder fibers.

A heat sensitive stencil sheet prepared by laminating a film and a porous substrate as mentioned above has a strength sufficient to endure the forces caused by printing action of printing machines, but when ink passes through the heat sensitive stencil sheet, specifically through perforations formed in the film, it can happen that the ink passes unevenly depending on dispersion state of the fibers of the porous substrate, causing printed images to be degraded in uniformity of density. In order to avoid it, a heat sensitive stencil sheet made of a single layer of film is proposed.

Methods for perforating the film of the heat sensitive stencil sheet to obtain a stencil plate include the following methods: (1) the film of the heat sensitive stencil sheet is kept in contact with an original having an image area composed of carbon, and is irradiated with infrared light, so that the film is perforated by the heat generated from the image area; (2) the film of the heat sensitive stencil sheet is kept in contact with a thermal head and is relatively moved whilst the thermal head is caused to generate heat at portions of heating elements corresponding to an original image, so that perforations are made in the film; and (3) a laser beam is modulated in accordance with an original image to scan the film of the heat sensitive stencil sheet, so that perforations are made in the film. Among the above methods, the method using infrared light is limited in kinds of originals, and cannot be used for data editing of documents and images. The method using a laser is not practically applied mainly because of the length of stencil plate making time. Therefore, at present, the method using a thermal head is mainly used.

In the stencil plate making process using a thermal head, numerous perforations two-dimensionally arranged in the main scanning direction and the sub scanning direction are formed in the film. In this case, it is desirable that perforations are made almost equal in shape and whose average opening ratio is suitable for printing conditions. If the perforations are uniform in shape, microscopic ink transfer states are uniform in printed image area, particularly in solid printed portions, so that density uniformity is achieved. On the contrary, if the perforations are uneven in shape, microscopic ink transfer states are uneven, and it can happen that thin lines are blurred, that density irregularity occurs in solid printed portions, and that excessively large perforations are formed which cause partially excessive ink transfer, hence set-off. Thus, to obtain perforations uniform in shape by respective heating elements, heating elements with various forms are proposed. Japanese Patent No. 2,732,532 proposes a method of obtaining independent perforations in both the main scanning direction and the sub scanning direction by keeping the pitch in the main scanning direction equal to the pitch in the sub scanning direction, keeping the length of heating elements in the main scanning direction shorter than the length in the sub scanning direction, and keeping the length of the heating elements in the sub scanning direction shorter than the pitch in the sub scanning direction. JP-A-4-3 14552 proposes a method of preventing that adjacent perforations in the main scanning direction are merged with each other, by disposing cooling members made of a material having a large heat conductivity between adjacent heating elements in the main scanning direction. JP-A-6-1 15042 proposes a method of processing a heat sensitive stencil sheet consisting only of a thermoplastic resin film into a stencil plate using a thermal head in which the length of heating elements in the main scanning direction is kept in a range of 15 to 75% of the pitch in the main scanning direction while the length of the heating elements in the sub scanning direction is kept in a range of 15 to 75% of the pitch in the sub scanning direction.

As for perforation pattern, planar forms (such as diameter, aspect ratio and area) and statistical states (such as average and variation) of perforations only have been discussed, but the rim configuration of perforations that gives a desirable ink transfer state can be seen only in the following proposals. Japanese Patent No. 2,638,390 proposes a method of obtaining independent perforations in both the main scanning direction and the sub scanning direction by specifying a relationship between four items; the length of heating elements in the main scanning direction, the length of heating elements in the sub scanning direction, the length of perforations in the main scanning direction and the length of perforations in the sub scanning direction. This patent describes that perforations possess rims. JP-A-6-320700 proposes a perforation method comprising the steps of heating a heat sensitive stencil sheet consisting essentially of only a film using a first thermal head from one side thereof and subsequently heating it from the other side thereof using a second thermal head. This patent describes that perforations possess sectional profiles. JP-A-8-20123 proposes a method of making a stencil plate from a heat sensitive stencil sheet consisting essentially of a 3.5 $\mu$m or thicker thermoplastic resin film only, in which perforations are formed to be conical in sectional form, with the dimensions of the conical section specified in relation to the pitch in the main scanning direction, in order to eliminate perforation shape irregularity caused by the substrate of the heat sensitive stencil sheet.

The above Japanese Patent No. 2,732,532, JP-A-4-314552, and JP-A-6-115042 may be useful for preventing expansion of perforations caused by merging of adjacent perforations and for making perforations uniform in shape, so that a desirable ink transfer state is realized. However, since perforation behavior of stencil sheets depends on physical properties of films, they cannot be said to be the best methods for controlling the shape of perforations with diverse heat shrinkable films.

Furthermore, though said Japanese Patent No. 2,638,390 and JP-A-6-320700 deal with rims and sectional profiles of perforations, they simply refer to existence of such features of perforations, but do not suggest any control method for uniformizing the rims of perforations and the sectional profile of perforations as well as the shape of perforations.

Moreover, the stencil plate making method described in said JP-A-8-20123 specifies, as described above, the relation between the dimensions of the conical section and the pitch in the main scanning direction, but it is a method of making a stencil plate from a heat sensitive stencil sheet consisting only of a thick thermoplastic resin film without any porous substrate. However, such a heat sensitive stencil sheet is presently not available as a commercial product, and has various other problems than irregularity of perforation shape. Furthermore, the method does not disclose at all any finding that the irregularity of perforation shape is influenced by sectional profile and width of rims of perforations.

In the case where it is intended to form through holes with a certain size in a stencil sheet, the resin in each portion to be perforated by a thermal head migrates to the rim portion surrounding each through hole, but it can happen that, depending on, for example, thermal physical properties of the film of the heat sensitive stencil sheet and heating conditions of heating elements of the thermal head, the resin accumulated in the rim portion inhibits the expansion of individual through holes, making it difficult to form through holes with a desired size, or making the shape of individual perforations more irregular, thereby causing macroscopic or microscopic density irregularity in prints, i.e., deterioration of image quality, or lowering reproducibility of patterns such as characters. If the through holes do not have the desired size, prints become insufficient in density. If, on the contrary, it is attempted to form through holes with a desired size by increasing energy applied to the heating elements of the thermal head, the heating elements may be damaged. On the other hand, in the case where the perforation configuration irregularity is conspicuous, it also happens that through holes of adjacent perforations are merged to form larger through holes, thereby allowing too much ink to be transferred through such holes to the paper, and causing set-off, etc. It is known that these undesirable phenomena are attributable, for example, to the thermal physical properties of the film and the heating conditions of the heating elements of the thermal head, but no particular finding has been obtained on the factors that determine perforation shapes, necessitating trials and errors.

This invention solves the above problems. The object of this invention is to provide a perforation pattern that inhibits perforation configuration irregularity while keeping through holes adequately sized without requiring any high temperature in the stencil plate making device.

BRIEF SUMMARY OF THE INVENTION

The inventors have intensively studied perforation behavior of heat sensitive stencil sheets to achieve the above object, and as a result, have found that if perforations are formed to ensure that the diameter and the rim width of perforations conform to certain conditions in relation to a pitch between adjacent perforations, perforation configuration irregularity can be inhibited to provide good prints, irrespectively of thickness and melting point of the film.

According to the first aspect of this invention, there is provided a method for producing a stencil plate, which comprises providing a heat sensitive stencil sheet having a heat shrinkable film, and selectively heating said film using a heating device to form independent dot perforations corresponding to an image in said film, wherein said heating device is set to ensure that said perforations satisfy the following formula (1):

$$p \geqq d+(\sqrt{2})f \quad (1)$$

where p denotes a scanning pitch in a main scanning direction or a sub scanning direction; d denotes an inner diameter of a perforation in the same direction as p; and f denotes a width of a rim of said perforation at a portion that is not merged with any rims of its adjacent perforations.

According to the second aspect of this invention, there is provided a method for producing a stencil plate, which comprises providing a heat sensitive stencil sheet having a heat shrinkable film, and selectively heating said film using a heating device to form independent dot perforations corresponding to an image in said film, wherein said heating device is set to ensure that said perforations satisfy the following formulae (2x) and (2y):

$$p_x \geqq d_x+(\sqrt{2})f_x \quad (2x)$$

$$p_y \geqq d_y+(\sqrt{2})f_y \quad (2y)$$

where $p_x$ and $p_y$ denote scanning pitches in a main scanning direction and a sub scanning direction respectively; $d_x$ and $d_y$ denote inner diameters of a perforation in a main scanning direction and in a sub scanning direction respectively; and $f_x$ and $f_y$ denote widths of a rim of said perforation at portions that are not merged with any rims of its adjacent perforations and have normal lines in a main scanning direction and a sub scanning direction respectively.

The above formulae (2x) and (2y) are convenient for accurately setting stencil plate making conditions in the case where ellipsoidal perforations are formed since the pitch of perforations in the main scanning direction is different from that in the sub scanning direction. However, the formulae can also be applied in the case where perforations are completely round.

According to the third aspect of this invention, there is provided an apparatus for producing a stencil plate from a heat sensitive stencil sheet having a heat shrinkable film, comprising a heating device which selectively heats said film to form independent dot perforations corresponding to an image in said film, said heating device being set to ensure that said perforations satisfy the following formula (1):

$$p \geqq d+(\sqrt{2})f \quad (1)$$

where p denotes a scanning pitch in a main scanning direction or a sub scanning direction; d denotes an inner diameter of a perforation in the same direction as p; and f denotes a width of a rim of said perforation at a portion that is not merged with any rims of its adjacent perforations.

According to the fourth aspect of this invention, there is provided an apparatus for producing a stencil plate from a heat sensitive stencil sheet having a heat shrinkable film, comprising a heating device which selectively heats said film to form independent dot perforations corresponding to an image in said film, said heating device being set to ensure that said perforations satisfy the following formulae (2x) and (2y):

$$p_x \geqq d_x+(\sqrt{2})f_x \quad (2x)$$

$$p_y \geqq d_y+(\sqrt{2})f_y \quad (2y)$$

where $p_x$ and $p_y$ denote scanning pitches in a main scanning direction and a sub scanning direction respectively; $d_x$ and $d_y$ denote inner diameters of a perforation in a main scanning direction and in a sub scanning direction respectively; and $f_x$ and $f_y$ denote widths of a rim of said perforation at portions that are not merged with any rims of its adjacent perforations and have normal lines in a main scanning direction and a sub scanning direction respectively.

According to the fifth aspect of this invention, there is provided a stencil plate which comprises a heat shrinkable film having independent dot perforations corresponding to an image, said perforations being formed by selectively heating said film with a heating device, wherein said perforations satisfy the following formula (1):

$$p \geqq d+(\sqrt{2})f \quad (1)$$

where p denotes a scanning pitch in a main scanning direction or a sub scanning direction; d denotes an inner diameter of a perforation in the same direction as p; and f denotes a width of a rim of said perforation at a portion that is not merged with any rims of its adjacent perforations.

According to the sixth aspect of this invention, there is provided a stencil plate which comprises a heat shrinkable film having independent dot perforations corresponding to an image, said perforations being formed by selectively heating said film with a heating device, wherein said perforations satisfy the following formulae (2x) and (2y):

$$p_x \geqq d_x + (\sqrt{2}) f_x \quad (2x)$$

$$p_y \geqq d_y + (\sqrt{2}) f_y \quad (2y)$$

where $p_x$ and $p_y$ denote scanning pitches in a main scanning direction and a sub scanning direction respectively; $d_x$ and $d_y$ denote inner diameters of a perforation in a main scanning direction and in a sub scanning direction respectively; and $f_x$ and $f_y$ denote widths of a rim of said perforation at portions that are not merged with any rims of its adjacent perforations and have normal lines in a main scanning direction and a sub scanning direction respectively.

According to the seventh aspect of this invention, there is provided a stencil sheet which comprises a heat shrinkable film destined to have independent dot perforations corresponding to an image by selectively heating said film with a heating device, wherein said perforations satisfy the following formula (1):

$$p \geqq d + (\sqrt{2}) f \quad (1)$$

where p denotes a scanning pitch in a main scanning direction or a sub scanning direction; d denotes an inner diameter of a perforation in the same direction as p; and f denotes a width of a rim of said perforation at a portion that is not merged with any rims of its adjacent perforations.

According to the eight aspect of this invention, there is provided a stencil sheet which comprises a heat shrinkable film destined to have independent dot perforations corresponding to an image by selectively heating said film with a heating device, wherein said perforations satisfy the following formulae (2x) and (2y):

$$p_x \geqq d_x + (\sqrt{2}) f_x \quad (2x)$$

$$p_y \geqq d_y + (\sqrt{2}) f_y \quad (2y)$$

where $p_x$ and $p_y$ denote scanning pitches in a main scanning direction and a sub scanning direction respectively; $d_x$ and $d_y$ denote inner diameters of a perforation in a main scanning direction and in a sub scanning direction respectively; and $f_x$ and $f_y$ denote widths of a rim of said perforation at portions that are not merged with any rims of its adjacent perforations and have normal lines in a main scanning direction and a sub scanning direction respectively.

BRIEF DESCRIPTION OF THE SEVERAL VIEWS OF THE DRAWING

This invention will be described below in detail, with reference to the drawings in which.

DETAILED DESCRIPTION OF THE INVENTION

As described before, heat sensitive stencil sheets include two kinds in view of constitution; a structure in which a film and a porous substrate are laminated together, and a single layer structure essentially consisting of a film. The following discussion does not rely on such a difference in the structure of the heat sensitive stencil sheet, and relates to configuration features of desirable perforations to be formed in the film of a heat sensitive stencil sheet, a method and apparatus for producing a stencil plate having perforations with such configuration features, a heat sensitive stencil sheet, and the nature of the stencil plate produced thereby. Hereinafter, the term "heat sensitive stencil sheet" means both a structure in which a film and a porous substrate are laminated together and a single layer structure essentially consisting of a film, without particularly distinguishing both the structures. Actually, this invention can be applied to both the heat sensitive stencil sheets of the two structures. Furthermore, hereinafter a perforated heat sensitive stencil sheet to be used for stencil printing is called a "stencil plate".

Figure 1A:
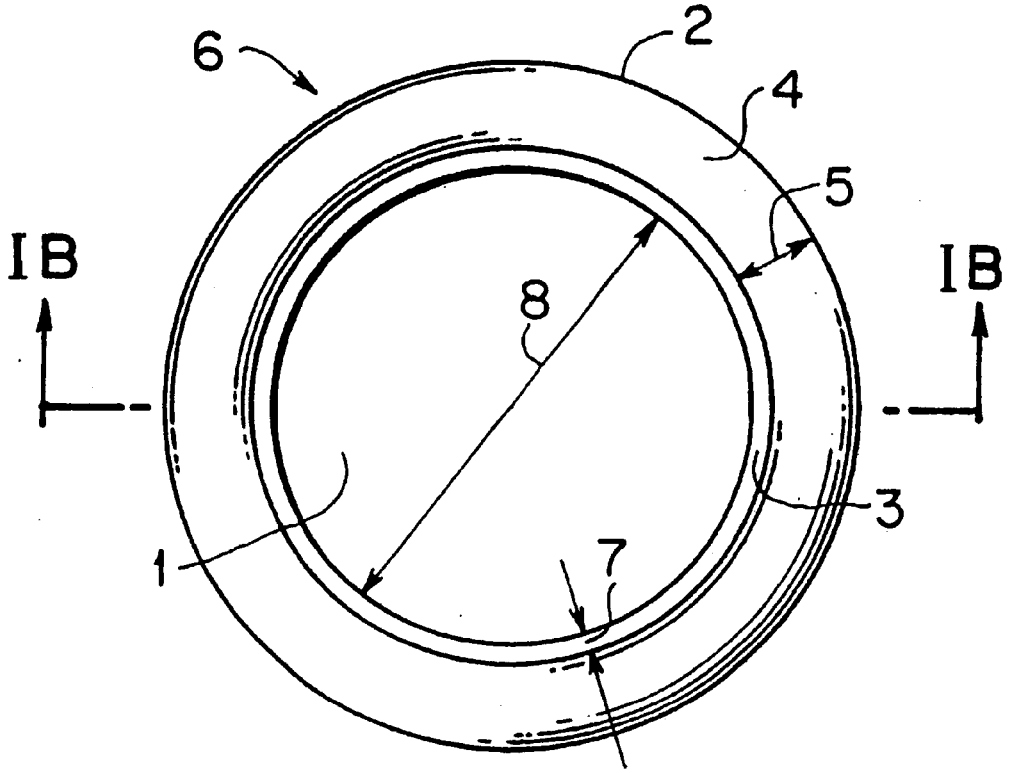
FIGS. 1A and 1B are respectively a typical plan view and a sectional view along the line IB—IB of FIG. 1A of a perforation formed in a heat shrinkable film of a heat sensitive stencil sheet.
Figure 1B:
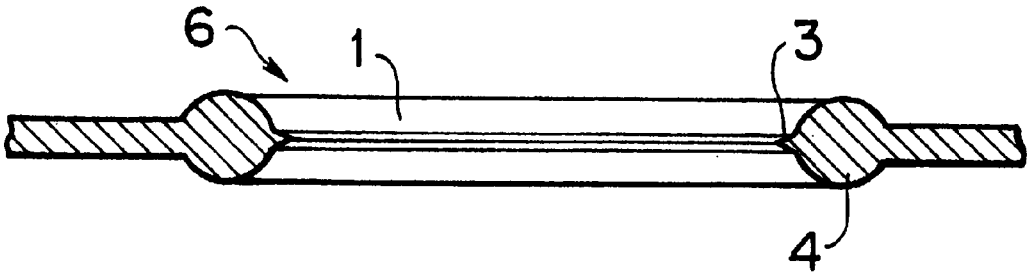

In general, each perforation 6 formed in a heat shrinkable film of a heat sensitive stencil sheet consists of, as shown in FIGS. 1A and 1B, a through portion and a deformed portion formed around it. This through portion is called a "through hole" in this specification. The deformed portion formed around the through hole 1 is changed in thickness compared with the film not yet processed into a stencil plate. This portion is called a "rim" in this specification. The rim 2 generally consists of a thin film portion near the inner circumference and a portion almost ellipsoidal in section in contact with the outside of the thin film portion and increasing sharply in thickness. In this specification, the former portion of the rim 2 is called a "thin rim portion" and the latter is called a "thick rim portion." The circumference of the through hole 1 is equal to the inner circumference of the thin rim portion 3, and the outer circumference of the thin rim portion is equal to the inner circumference of the thick rim portion. The width 7 of the thin rim portion in the radial direction of the perforation depends on the film and the stencil plate making conditions, but is about 0 to 5% of the diameter 8 of the through hole, and it can happen that the thin rim portion 3 is not formed. The thick rim portion 4 becomes thicker than the thickness of the film not yet processed into a stencil plate or of the portion not deformed by the stencil plate making process. In general, the volume of the thin rim portion 3 is negligibly small compared with the volume of the thick rim portion 4. Therefore, in this specification, in the case where a "rim" is referred to, it means the thick rim portion 4, and in the case where "the width of a rim" is simply referred to, it means the width 5 of the thick rim portion 4 in the radial direction of the perforation. Furthermore, in this specification, perforation(s)" means the whole consisting of the through hole 1, the thin rim portion 3 and the thick rim portion 4, and the work of forming the perforation is called "perforate" or "perforation." Moreover, in this specification, in the case where an "inner diameter of a perforation" is referred to, it means the inner diameter of the thick rim portion 4.

In the study concerning this invention, the inventors have found a method for evaluating the perforation phenomenon from a novel point of view. That is, in the phenomenon that a heat shrinkable film is perforated by means of the thermal head that is used most generally at present among the methods for processing a heat sensitive stencil sheet into a stencil plate, behavior that each perforation is formed and expanded in the film with lapse of time has been observed in a microscope view of field on the order of $\mu$m using an apparatus capable of picking up an image at a high speed on the order of $\mu$s. As a result, it has been found that a series of perforation behavior could be divided into the following four stages.

Figure 2:
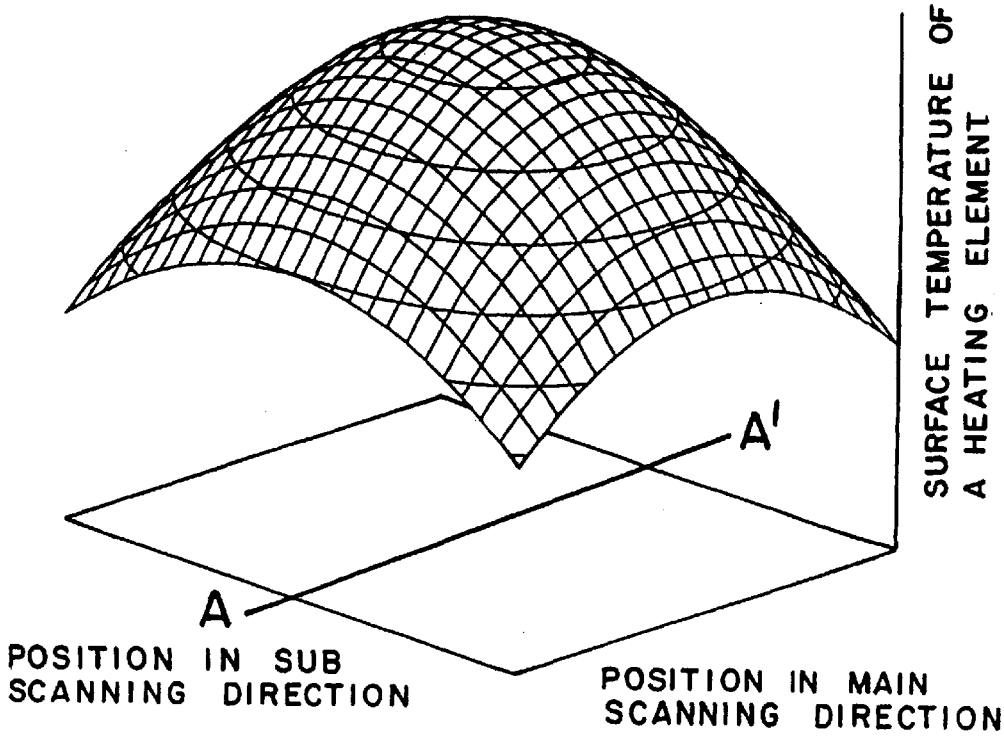
FIG. 2 is a graph showing the temperature distribution of a heating element of a thermal head.
Figure 3:
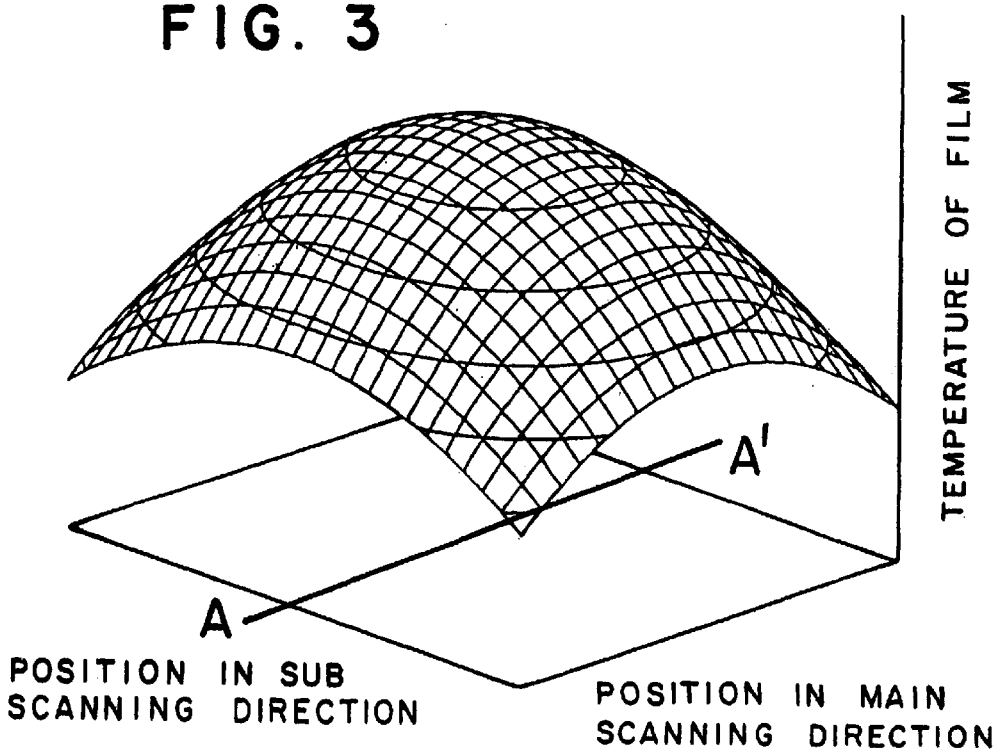
FIG. 3 is a graph showing the temperature distribution of a film heated by a heating element of a thermal head.
Figure 4:
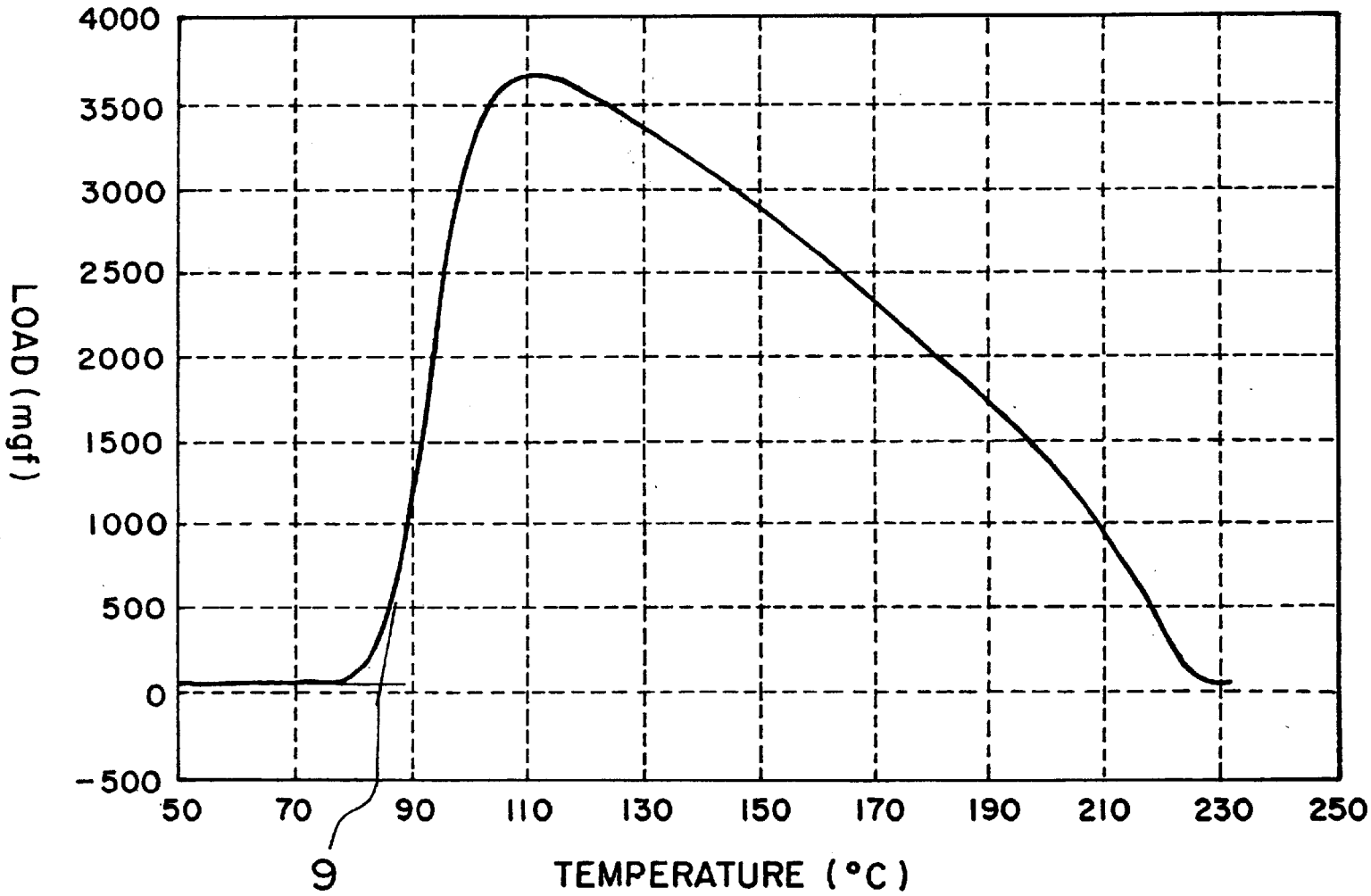
FIG. 4 is a graph showing the relation between the temperature and the heat shrinkage stress of a heat shrinkable film of a heat sensitive stencil sheet.
Figure 5:
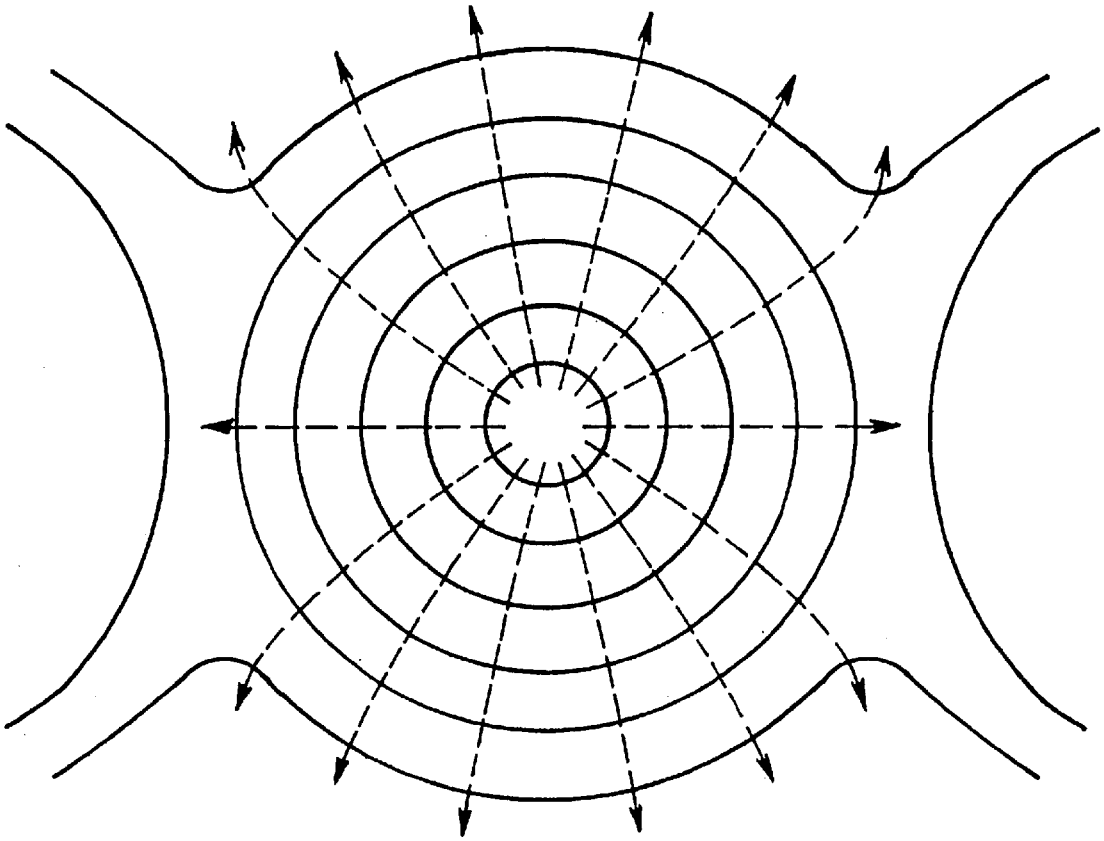
FIG. 5 is a typical plan view showing the resin migrating directions when a heat shrinkable film of a heat sensitive stencil sheet is perforated with heating.

In the first stage, as shown in FIG. 2, the film is heated by heating elements of a thermal head, each of which has a temperature distribution in which the temperature is highest at the central portion and declines with increase of distance from the central portion toward periphery. As shown in FIG. 3, the film has the highest temperature at a portion contacted by the center of the heating element and becomes lower in temperature with increase of distance from that portion. If the film exceeds the temperature 9 at which shrinkage begins (hereinafter this temperature is called "shrinkage initiation temperature"), as shown in FIG. 4, a force for shortening mutual distance (i.e., heat shrinkage stress) occurs. So, everywhere in the region higher than the shrinkage initiation temperature 9, tension occurs. Directions of the tension are almost (or perfectly if the heat shrinkage is isotropic) perpendicular to the isothermal lines on the film. On the other hand, in places where the film temperature is sufficiently low, the resin of the film does not migrate since no shrinkage stress occurs. So, the resin of the film migrates from the highest temperature portion of the film toward the peripheral portion, as if sliding down on the slope of FIG. 3. In FIG. 5, the temperature distribution (isothermal lines) of the film occurring when heating elements adjacent in the main scanning direction generate heat is shown as solid lines, and the directions in which the temperature declines perpendicularly to the isothermal lines are indicated by dotted arrows. That is, the resin of the film migrates in the directions of the dotted lines of FIG. 5.

In the second stage, near each of the highest temperature portions of the film, a first small through hole is formed. This is the initiation of formation of a perforation.

In the third stage, the outer circumference of the formed small through hole is pulled outwardly by the tension from outside the outer circumference. This is growth of a perforation due to heat shrinkage. The peripheral portion of the outer circumference of the through hole is expanded outwardly while taking in the resin existing on the way, to increase its volume, thus forming a rim. The rim in this case is a molten or softened resin, and therefore, the sectional form is close to a circle or ellipsoid due to surface tension. In this stage, the surface tension affects the sectional form of the rim, but does not substantially affect the position of the rim, namely, the size of the through hole.

In the fourth stage, with the voltage application to the heating element terminated, the temperature of the heating element declines, and subsequently, the temperature of the film also declines. As a result, the temperatures of the rim and the portion outside the rim become lower than the shrinkage initiation temperature 9. At this moment, since the rim is not pulled toward the peripheral portion, configuration of the perforation is fixed. This is completion of the perforation due to heat shrinkage.

In general, a heat shrinkable film shows heat-shrinking behavior in a plane direction of the film in a certain temperature range. If this temperature range is kept till the heat-shrinking behavior is completed, a subsequent heating simply causes softening or melting and causes little shrinkage. It is considered that the resin of the rim portion of each perforation is in a state where heat shrinkage has been completed. Therefore, unless a portion to pull the rim outwardly, i.e., a portion in a state where heat shrinkage is not completed exists outside the rim, the rim can no longer be expanded with heat shrinkage.

If an isolated perforation is formed with no adjacent perforation, a larger perforation can be formed with heat shrinkage by elevating the temperature above the shrinkage initiation temperature 9 at a larger region on the film, irrespectively of the pixel pitch and the size of the heating element. However, in the case where there are perforations of adjacent pixels as in a solid printed portion, if rims of adjacent perforations contact and merge with each other due to the growth of perforations, the perforations cannot be caused to grow further with heat shrinkage since no portions in a state where heat shrinkage is not completed exist outside the rims.

However, the inventors have found that there were conventionally cases where through holes of perforations were expanded in size beyond the expansion caused by heat shrinkage. This often depends on paper quality, etc. For example, in the case where image dots transferred onto paper through the largest through holes expanded just by heat shrinkage were not large enough, that is, where the dot gain was small, it was practiced, as the case may be, to make the through holes empirically larger for obtaining a printed matter without any clearance between pixels.

Furthermore, it has been found that in the case where resolution of a stencil plate was enhanced, it was practiced, as the case may be, to make through holes larger than the maximum size expanded just by heat shrinkage. The resolutions in stencil printing were mainly 300 dpi to 400 dpi till recently, but in recent years, machines of 600 dpi have been commercialized in a tendency toward higher resolution. To achieve the same level of ink transfer, that is, to achieve the same printing density level irrespectively of the resolution, it is necessary to set the ratio of the area of through holes to the area of the stencil plate (hereinafter this is called "opening ratio") at the same level irrespectively of the resolution. On the other hand, enhancing the resolution with the film thickness and the opening ratio being kept constant is three-dimensionally similar to making the film thickness larger with the resolution and the opening ratio being kept constant, and in this case, the rims become relatively wider. As the case may be, the rim formed between the two through holes of adjacent perforations becomes wider than the desired clearance between the through holes. Therefore, in this case, in order to obtain an image higher in density, it was often practiced to make the through holes larger than the largest size expanded just by heat shrinkage.

Figure 6:
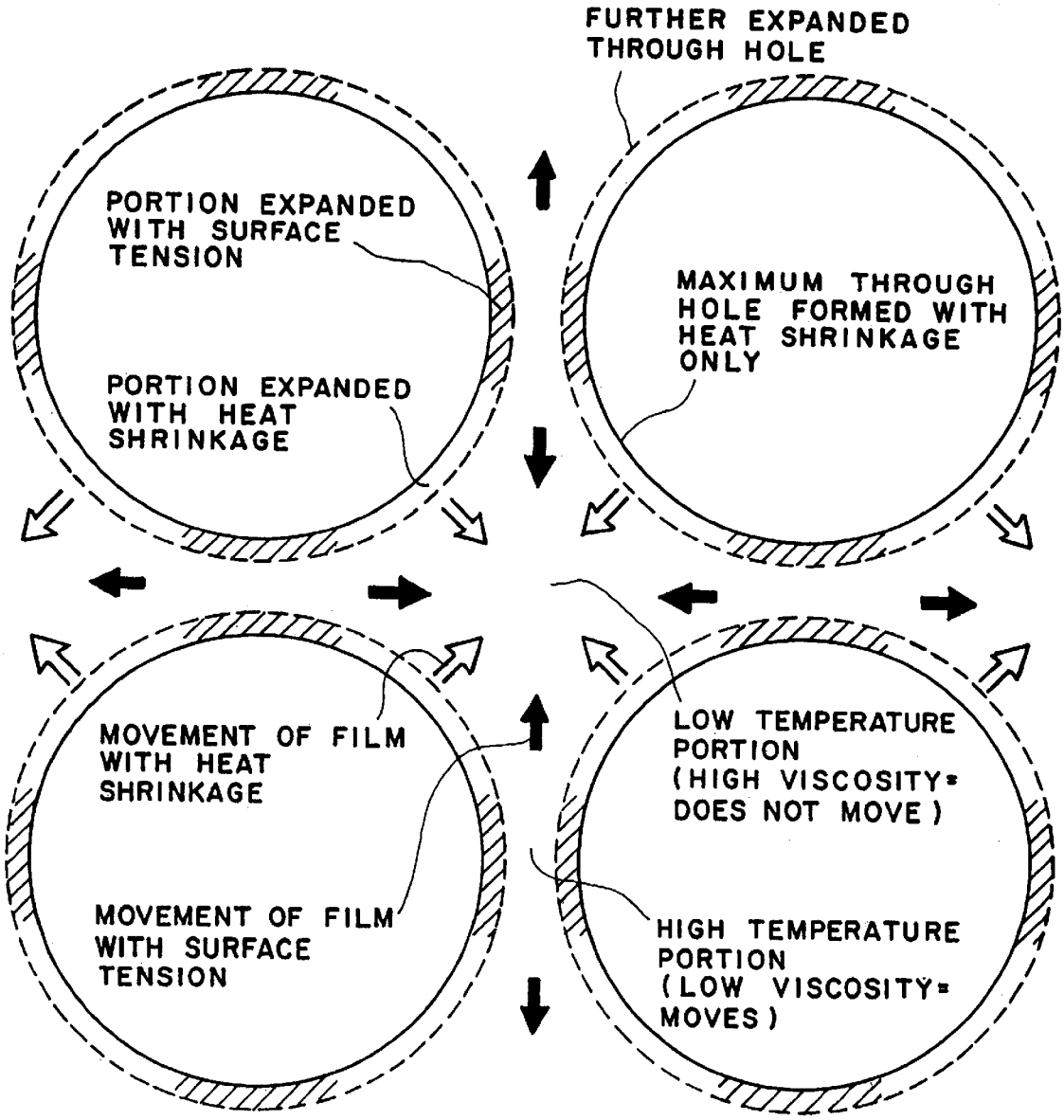
FIG. 6 is a typical plan view for illustrating the perforation behavior with heat shrinkage and hot melt of a heat shrinkable film of a heat sensitive stencil sheet.

It has been found that in the case where the size of the through hole of each perforation is expanded beyond the expansion caused by heat shrinkage, the following process occurs instead of the fourth stage of the above-mentioned perforation behavior. That is, the rim portions between adjacent perforations in a solid printed portion are forced to migrate due to surface tension even after the rims have contacted and merged with each other due to the growth of perforations. For this purpose, the rims and the portions outside them are kept heated. The rims are heated to be sufficiently soft, so that the migration due to surface tension occurs. This phenomenon is shown in FIG. 6. The migration due to surface tension occurs from low viscosity portions (i.e., the high temperature portions located between adjacent through holes) toward high viscosity portions (i.e., the low temperature portions located between diagonally adjacent through holes). As to the growth of perforations due to surface tension, see the closed thick arrows in FIG. 6. Since there are portions where the heat shrinkage of the film is not completed between diagonally adjacent through holes, the through holes are further expanded toward the diagonally adjacent through holes due to heat shrinkage. As to the growth of perforation due to heat shrinkage, see the open thick arrows in FIG. 6. Then, with the voltage application to the heating elements terminated, the temperature of the heating elements declines, and subsequently the temperature of the film also declines. As a result, the temperatures of the rims and the portions outside them become lower than the shrinkage initiation temperature, and the rims are no longer pulled toward the peripheral portions. If the temperature of the rim portions declines, the viscosity rises, and the migration due to surface tension is also stopped. Thus, the configuration of perforations are fixed. This is termination of perforation.

As for the growth area of each through hole obtained with heat 25 shrinkage and that obtained with surface tension, if the heat quantity is the same, the latter is very small compared with the former. That is, the perforation efficiency with surface tension is much smaller than that with heat shrinkage. This can be seen also from the fact that the energy required for perforating a heat sensitive stencil sheet having a non-heat shrinkable film is far more larger than the energy required for perforating a heat sensitive stencil sheet having a heat shrinkable film.

In the case where the rims of perforations obtained with through holes of a certain size in a stencil plate are relatively wide due to the structures of the heat sensitive stencil sheet and its film, stencil plate making conditions, etc. and where the size of through holes required to meet a desirable ink transfer amount and a printing density level is larger than the size of the largest through holes obtained with heat shrinkage, there is no other way than expanding the through holes with surface tension.

In the expansion (i.e., resin migration) of each through hole with surface tension, migration rate depends on quantity and viscosity of the resin in the rim. The quantity of the resin depends on the volume of the resin that had existed in the film portion corresponding to the through hole that have been perforated with heat shrinkage. The viscosity of the resin depends on the temperature of the resin. The temperature of the resin depends on the distance between the film and the heating element, the heat capacities of the support fibers and adhesive in contact with the film, the heat quantity reserved in the rim in the process of heat shrinkage till then, and the quantity of the resin. The distance between the film and the heating element and the heat capacities of the support fibers and adhesive in contact with the film are different from a microscopic place to a microscopic place in the heat sensitive stencil sheet. Therefore, the perforation configuration obtained with surface tension is different from a microscopic place to a microscopic place in the heat sensitive stencil sheet.

Of course, perforation (i.e., resin migration) due to heat shrinkage also depends on the temperature of the resin. Therefore, the perforation configuration obtained with heat shrinkage also becomes different from a microscopic place to a microscopic place in the heat sensitive stencil sheet. However, irregularity of perforation configuration caused with surface tension is more remarkable than irregularity of the perforation configuration caused with heat shrinkage. The reason is that the perforation configuration irregularity caused with surface tension includes the perforation configuration irregularity caused with heat shrinkage and the perforation configuration irregularity caused with surface tension only, and that the perforation configuration irregularity caused with surface tension only is greatly affected by the perforation configuration irregularity caused with heat shrinkage.

Therefore, in this case, if through holes are expanded with surface tension in addition to heat shrinkage, to realize through holes with a desired size, the perforation configuration irregularity depending on microscopic places becomes large compared with the perforation configuration irregularity caused with heat shrinkage only. If this irregularity (particularly irregularity in diameter of through holes) becomes more than a certain level, a phenomenon that adjacent through holes in a solid printed portion are merged with each other occurs. If such a stencil plate is used for printing, the ink transfer irregularity, i.e., density irregularity in a solid printed portion becomes large. That is, the solid printed portion presents a rough feeling to lower density uniformity. At the same time, thin characters are blurred and saturated. Furthermore, in a printed portion large in ink transfer amount, set-off and seep-through occur.

Moreover in this case, it is necessary to heat the film to higher than the temperature necessary for the perforation with heat shrinkage, for expanding the through holes with surface tension in addition to heat shrinkage. Therefore, voltage application conditions must be set to make the heating elements higher in temperature. In addition, the perforation efficiency with surface tension is very smaller than the perforation efficiency with heat shrinkage. For these reasons, firstly, the power consumption in the stencil plate making process increases. Furthermore, if a longer voltage application time is set, the stencil plate making time also becomes generally longer. Secondly, the heating elements encounter a higher temperature, and the time during which the heating elements are kept at a temperature higher than a certain level becomes longer. So, the heating elements are likely to be deteriorated. In the case of a thermal head widely used as a heating device for making heat sensitive stencil plates, since the heating temperature range is already very close to the critical service temperature, this tendency is more remarkable.

In order to inhibit such disadvantages that perforation configuration irregularity depending on microscopic places becomes large to cause density irregularity in solid printed portions of a printed matter, that thin characters are blurred and saturated, that set-off and seep-through occur, that the power consumption in the stencil plate making process increases, that the stencil making time becomes longer and that the heating elements are likely to be deteriorated, this invention proposes to satisfy said formula (1) and said formulae (2x) and (2y), for the purpose of limiting the size of through holes of perforations to the size obtained with heat shrinkage only. These formulae are derived as described below.

When a film is perforated with heat shrinkage, the mass balance of the resin of the film in each perforation before and after the perforation of the film is zero. That is, the mass of the resin of the film before perforation is not different from that after perforation. Therefore, the mass of the resin that had existed in the place of the through hole before perforation is equal to the mass increment in the rim after perforation.

On the other hand, density of the resin in the rim after perforation was 1% larger than density of the resin that had existed in the place of the through hole before perforation, according to measurement carried out by the inventors. That is, it is known that the density of PET (polyethylene terephthalate) typically used for heat shrinkable films of heat sensitive stencil sheets is inversely proportional to the half value width of the peak (1730 $cm^{-1}$) of C=O group in the Raman spectrum (A. J. Melveger, J. Polym. Sci., 10, 317 (1972)). The half value width before perforation was 23 $cm^{-1}$ (density≈1.35), and the half value width of the rim after perforation was 20 $cm^{-1}$ (density≈1.365). Therefore, it can be considered that the density of the resin does not substantially change after perforation compared with that before perforation. So, it can be said that the volume of the resin that had existed in the place of a through hole before perforation is almost equal to the volume increment of the rim after perforation. In the following description, it is assumed that the volume of the entire resin neither increases nor decreases after perforation compared with that before perforation. It is also assumed that the thin rim portions are not formed. The reason is that since the following discussion is concerned with analysis of volume of each rim and since the entire volume of a rim is almost equal to the volume of the thick rim portion, existence of the thin rim portion can be disregarded.

Figure 7A:
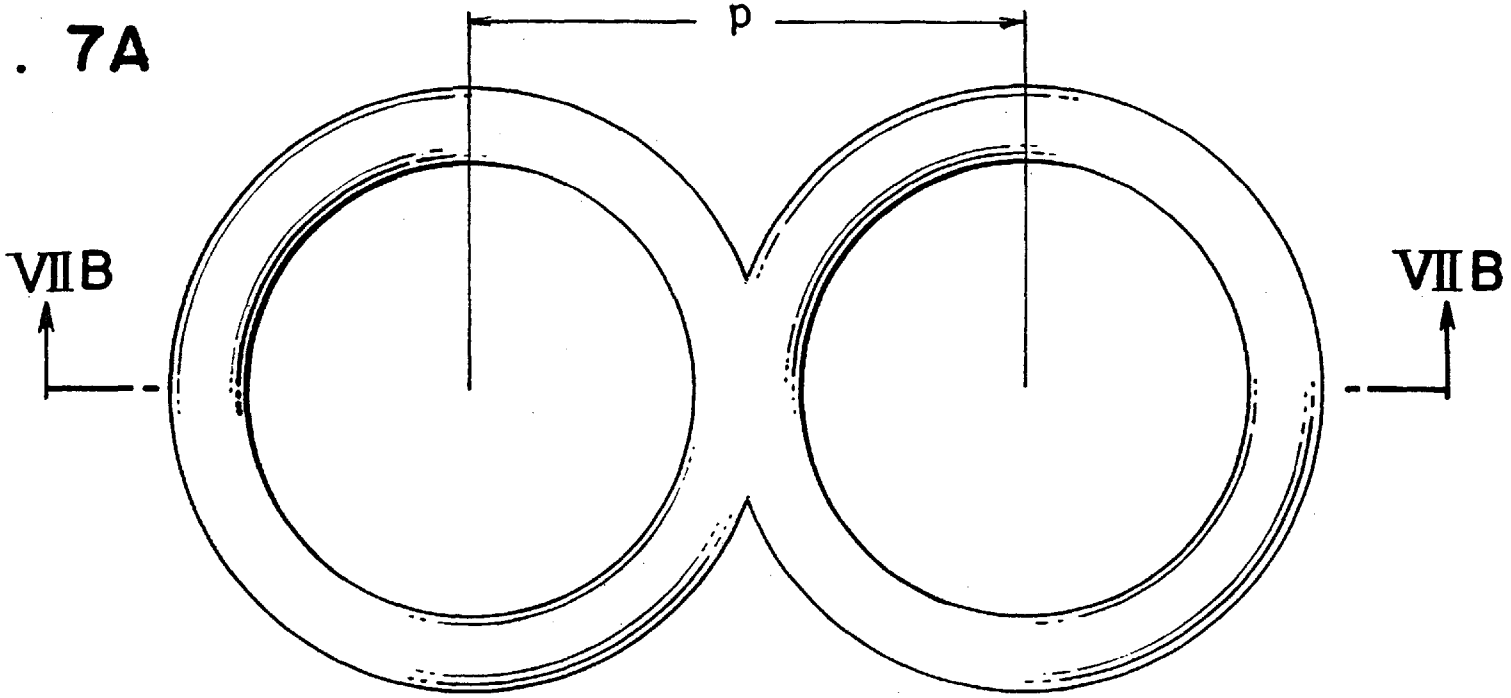
FIGS. 7A and 7B are respectively a typical plan view and a sectional view along the line VIIB—VIIB of FIG. 7A showing the relation between two adjacent perforations formed in a heat shrinkable film of a heat sensitive stencil sheet.
Figure 7B:
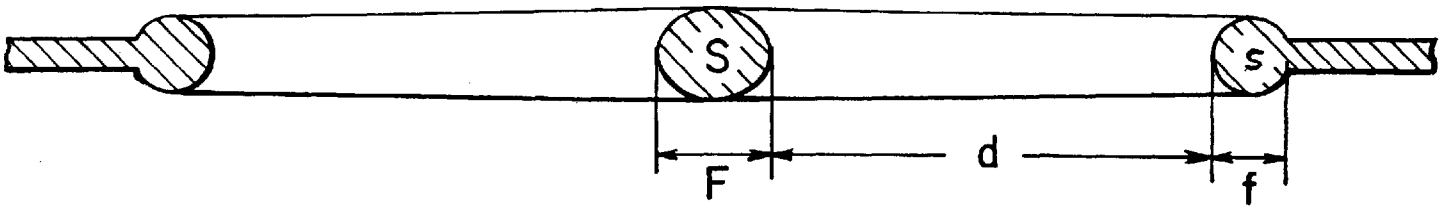

Subject to these assumptions, the above formulae are described below in reference to FIGS. 7A and 7B. In FIGS. 7A and 7B, p denotes the pitch between adjacent perforations (scanning pitch); d denotes the inner diameter of a perforation; f denotes the width of a rim at the portion not merged with the rim of an adjacent perforation; s denotes the sectional area of a rim at the portion not merged with the rim of an adjacent perforation; F denotes a distance between through holes of adjacent perforations; and S denotes a sectional area of the merged rim portion between through holes of adjacent perforations. The f, s, F and S in the case where perforation realizes the largest through holes obtained with heat shrinkage are respectively expressed as $f_0$, $s_0$, $F_0$ and $S_0$.

According to the inventors' experiment, the sectional configuration of the rim at the portion not merged with any adjacent perforation is close to an oblate ellipsoid that is long in the width direction of the rim (i.e., the normal direction of the rim in the film plane) and short in the thickness direction of the film, and the oblateness α (=long axis/short axis ratio) is about 3 or less. Namely, $$1 \leqq \alpha \leqq 3. \tag{3}$$

Since the width of the rim is f, the thickness of the rim is f/α. Hence, $$s = \frac{\pi f^2}{4\alpha}. \tag{4}$$

In this case, it is assumed that neither f nor s depends on the angle from the center of the perforation. That is, it is assumed that both f and s are isotropic; this assumption holds when the rim viewed from right above is completely round. In the case where the density in the main scanning direction is equal to the density in the sub scanning direction and where each perforation is formed at each pixel, the intervals of perforations (or though holes) in the main scanning direction are usually set to be equal to those in the sub scanning direction and the perforations become almost completely round in plane form. So, f and s can be regarded to be isotropic.

When adjacent perforations are respectively expanded to the maximum extent with heat shrinkage, through holes with the maximum size in a state of less perforation irregularity are formed. The f and s in this case are expressed as $f_0$ and $s_0$ respectively. To obtain a desirable perforation state, $$f \leqq f_0 \tag{5}$$

must hold.

Both $f_0$ and $s_0$ conform to formula (4). Hence, $$s_0 = \frac{\pi f_0^2}{4\alpha}. \tag{6}$$

On the other hand, at $f=f_0$ (as described above, this state is a state where the perforations are expanded to the maximum extent with heat shrinkage), the rims between adjacent perforations are merged with each other, and the width $F_0$ becomes the smallest due to surface tension, that is, the rims become completely round. The sectional area $S_0$ of the merged rims is $$S_0 = 2s_0 = \frac{\pi F_0^2}{4}. \tag{7}$$

To obtain a desirable perforation state, the distance F between the through holes of adjacent perforations cannot be smaller than $F_0$.

$$F \geqq F_0. \tag{8}$$

where F is expressed by the scanning pitch p and the diameter d of each through hole as follows:

$$F = p - d. \tag{9}$$

Therefore, from formulae (5), (6), (7), (8) and (9), $$f \leq \sqrt{\frac{\alpha}{2}}\,(p - d) \tag{10}$$

In this case, to ensure that formula (10) holds irrespectively of the value of α within the range of formula (3), $$p \geqq d + \sqrt{2} f \tag{11}$$

is given.

So far, f has been assumed to be isotropic, but actually, p, d and f are not always isotropic. In the case where the pitch in the main scanning direction is different from the pitch in the sub scanning direction, p is not isotropic, and in the case where the through holes are oblate in plane form in either the main scanning direction or the sub scanning direction, d and f are not isotropic; and f depends on the volume of the resin that have migrated from the through hole portion to the rim portion. Actually, for example, assuming Density in main scanning direction=300 (dpi)

Density in sub scanning direction=400 (dpi)

$d_x/d_y = p_x/p_y = 1.33$

Opening ratio=40% and assuming that each through hole is an ellipsoid having a major axis equal to the pitch in the main direction and a minor axis equal to the pitch in the sub scanning direction, calculation gives $d_x$=60.4 μm $d_y$=45.3 μm.

In this case, f depends on the angle from the center of each perforation, and the maximum value is $f_x$ while the minimum value is $f_y$. However, $f_x/f_y$ is not so large as $p_x/p_y$ or $d_x/d_y$.

The analysis with a film thickness of 2 μm gives:

$f_x/f_y$=7.6 (μm)/6.8 (μm)=1.12 if the oblateness of the sectional form of each rim is 1, and $f_x/f_y$=15.2 (μm)/13.9 (μm)=1.09 if the oblateness of the sectional form of each rim is 3.

The difference between the values of $f_x$ and $f_y$ is as small as about 10%, and it may be within an error range, though depending on the measuring means. In Comparative Example 2 and Example 4 described later, Density in main scanning direction=300 dpi Density in sub scanning direction=400 dpi.

Also, $d_x/d_y$ was almost equal to $p_x/p_y$. In this case, isolated perforations that had no adjacent perforation were measured and the following were found:

$f_x/f_y$=1.07 in Comparative Example 2

$f_x/f_y$=1.08 in Example 4.

That is, these values were close to the above values, thereby supporting the result of the above analysis. Therefore, d and f are anisotropic, but f can be regarded to be isotropic without any substantial problem. Based on this concept, formula (1) of this invention is proposed.

Formulae (2x) and (2y) in the claims of this invention are proposed with the main scanning direction distinguished from the sub scanning direction, considering the anisotropy of p, d and f in formula (11). In this case, if adjacent perforations exist, it often occurs that their rims are merged with each other. So, in the formulae, to clarify the use of the width of each rim at the portion not merged with the rim of any adjacent perforation, $f_x$ and $f_y$ are specified as the widths of rims at portions which are not merged with rims of any adjacent perorations and have each normal line in a main scanning direction and in a sub scanning direction respectively.

The pitches in the main scanning direction and in the sub scanning direction depend upon a specification of a heat sensitive stencil plate making device to be used, and a desired diameter of through holes, namely, the inner diameter of perforations is determined in accordance with a desired image quality of prints. Therefore, in order to set the perforation pattern as in the claims of this invention, the width of each rim is controlled, and for this purpose, various methods can be used. The width of rim depends on the volume of the resin that had existed in the place of the through hole before perforation and the oblateness (i.e., width/thickness) of the sectional form of the rim. The volume of the resin that had existed in the place of the through hole before perforation can be controlled by means of selecting a film thickness if the area of the through hole is constant. The oblateness of the sectional form of the rim can be controlled by means of changing thermal physical properties (e.g., heat shrinkage, melting point, melt viscosity, heat capacity, etc.) of the film and a spatial distribution and temporal variation of temperatures of the heating device.

In the above description, the heating elements of a thermal head were often referred to as a heating device, but since this invention can be applied to the phenomena in general of perforating a heat shrinkable film with heating, the heating device is not limited to the thermal head. In this invention, a laser beam source, active energy beam source and many other devices can be used.

DESCRIPTION OF THE PREFERRED EMBODIMENT

EXAMPLES

This invention is described below based on examples and comparative examples. The stencil plate making conditions, measured values of perforation configurations, evaluation of perforations and evaluation of prints in the respective examples and comparative examples are shown in Table 1. Methods for measuring the physical properties shown in Table 1 were as follows.

Value of Formula (1)

The value of the left side minus the right side of formula (1) is shown. The value of $p_x-(d_x+(\sqrt{2})f)$ is the value in the case where the pitch between adjacent perforations and the inner diameter in the main scanning direction are used, and the value of $p_y-(d_y+(\sqrt{2})f)$ is the value in the case where the pitch between adjacent perforations and the inner diameter in the sub scanning direction are used. If either of the values is positive, the requirement of this invention is satisfied.

Values of Formulae (2x) and (2y)

The values of the left side minus the right side of formulae (2x) and (2y) are shown. If the values of both the formulae are positive, the requirement of this invention is satisfied.

Stencil Plate Evaluation Conditions

In the examples and comparative examples, each stencil was prepared using an experimental stencil plate making device and a heat sensitive stencil sheet which respectively satisfy the respective conditions (i.e., resolution, pitch, heating element size, applied energy, periods, physical properties of film) shown in Table 1. The other common conditions of the heat sensitive stencil sheet were as follows. As for materials, various polyester resins different in mixing ratio were biaxially oriented to form films having a thickness and melting point shown in Table 1. Each of the films and 35 μm thick mixed paper with a unit weight of 10 g/m$^2$ consisting of Manila hemp and polyester fibers as a porous substrate were laminated with 0.5 g/m$^2$ of polyvinyl acetate resin kept between them, and the film surface was coated with 0.1 g/m$^2$ of a silicone resin, to prepare a heat sensitive stencil sheet. The environmental temperature was room temperature.

Diameter of Through Holes, Inner Diameter of Thick Rim Portions, Width of Thick Rim Portions Stencil plates having solid pattern were prepared. From photographs of the stencil plates in regions similar in heat history state (specifically, regions within 5 mm to 15 mm in the sub scanning direction downstream from the plate-making initiation line) taken through an optical microscope, diameters of through holes, inner diameters of thick rim portions and widths of thick rim portions were respectively measured in terms of 20 perforations, and they were averaged.

SN Ratio of Areas of Through Holes

Stencil plates having solid pattern were prepared. From images of the stencil plates in regions similar in heat history state (specifically, region within 5 mm to 15 mm in the sub scanning direction downstream from the plate-making initiation line) taken by a CCD camera through an optical microscope, through holes of 100 perforations were cut out by means of binarization using Image Analyzer Package MacSCOPE produced by Mitani Shoji K. K., and the SN ratio of the areas of the through holes was obtained therefrom.

The SN ratio of areas of the through holes is on the "nominal the best" basis. If this value is larger, the perforated areas are less irregular. The SN ratio of perforated areas depends on measuring conditions and is difficult to evaluate simply. Empirically the inventors consider that in order to achieve uniformity in state of transfer from the respective perforations, 10 db or more is realistically necessary, and 13 db or more is desirable, and the SN ratio of less than 10 db is troublesome.

Print Evaluation Conditions

In the examples and comparative examples, the obtained stencil plate was manually installed around the printing drum for printing using a stencil printing machine, RISOGRAPH GR377 (registered trademark) brand machine produced by Riso Kagaku Corporation under the standard conditions (i.e., the default settings when the power was turned on) and RISOGRAPLI Ink GR-HD (trade name) brand ink produced by Riso Kagaku Corporation. The environmental temperature was room temperature.

Uniformity of Solid Printed Portions

As for the uniformity of solid printed portions, degree of density irregularity in microscopic places (at intervals of about 1 mm or less) caused by perforation configuration irregularity in solid printed portions of prints was subjectively evaluated according to the following criterion:

◎: Density irregularity was not felt at all.

○: Density irregularity was slightly observed, but both solid reproducibility of characters and tone reproducibility of photographs were on practical levels.

Δ: Solid reproducibility of characters was on a practical level, but tone reproducibility of shadow portions of photographs was poor.

X: Density irregularity was remarkable, and both solid reproducibility of characters and tone reproducibility of photographs were poor.

Blurring of Fine Characters

As for the blurring of fine characters, degree of blurring (e.g., partial lack of continuous lines) caused by perforation configuration irregularity in fine characters portions of prints was subjectively evaluated according to the following criterion:

◎: Blurring was not felt at all.

○: Slight blurring was observed, but both reproducibility of fine characters (black characters on white background) and tone reproducibility of highlight portions of photographs were on practical levels.

Δ: Reproducibility of fine characters (black characters on white background) was on a practical level, but tone reproducibility of highlight portions of photographs was poor.

X: Blurring was remarkable, and both reproducibility of fine characters (black characters on white background) and tone reproducibility of highlight portions of photographs were poor.

Saturation of Fine Characters

As for the saturation of fine characters, degree of saturation (partial lack of a blank that should exist between nearby two character lines) caused by perforation configuration irregularity was subjectively evaluated according to the following criterion:

◎: Saturation was not felt at all.

○: Slight saturation was observed, but both reproducibility of fine characters (white characters on black background) and tone reproducibility of shadow portions of photographs were on practical levels.

Δ: Reproducibility of fine characters (white characters on black background) was on a practical level, but tone reproducibility of shadow portions of photographs was poor.

X: Saturation was remarkable, and both reproducibility of fine characters (white characters on black background) and tone reproducibility of shadow portions of photographs were poor.

Set-Off

As for the set-off, degree of stain caused by ink transferred from a printed surface of one print to the back side of another print placed on the one print immediately after printing was subjectively evaluated according to the following criterion:

◎: Set-off was not felt at all.

○: Slight set-off was observed, but prints obtained from an original with a large solid printed portion, hence large in ink transfer were on a practical level, and they could be used as official prints.

Δ:Prints were on a practical level at portions small in ink transfer such as fine characters (black characters on white background) and highlight portions, but stain was outstanding at portions large in ink transfer such as large solid printed portions. The prints could be used as unofficial prints, but could not be used as official prints.

X: Set-off was remarkable. Stain was outstanding at almost all printed portions. The prints could not be used even as unofficial prints.

Comparative Example 1

A heat sensitive stencil sheet was processed into a stencil plate at resolutions of 400 dpi in both the main scanning direction and the sub scanning direction with the target inner diameters of through holes as 42.5 μm in both the main scanning direction and the sub scanning direction, and the stencil plate was used for printing.

In this case, the value of formula (1) and the values of formulae (2x) and (2y) became negative and did not conform to the requirement of this invention.

Example 1

A stencil plate was prepared and used for printing as described for Comparative Example 1, except that the thickness of the film was made thinner to 1.7 μm in place of 2.5 μm of Comparative Example 1, and applied energy was correspondingly decreased. As a result, the volume of the resin that had existed in the place of each through hole decreased, and the width of each thick rim portion deceased. Furthermore, the value of formula (1) and the values of formulae (2x) and (2y) became positive and conformed to the requirement of this invention.

Example 2

A stencil plate was prepared and used for printing as described for Comparative Example 1, except that the melting point of the film was lowered to 189° C. in place of 226° C. of Comparative Example 1, and that the size of the heating elements was decreased to 25×33 μm in place of 30×40 μm of Comparative Example 1, with the applied energy density (energy applied per unit area of heating elements) raised.

As a result, while through holes with almost the same diameter were formed, the viscosity of the thick rim portions declined to decrease the oblateness of each thick rim portion, and the width of each thick rim portion decreased. Furthermore, the value of formula (1) and the values of formulae (2x) and (2y) became positive and conformed to the requirement of this invention.

Example 3

A stencil plate was prepared and used for printing as described for Comparative Example 1, except that the thickness of the film was made thinner to 1.7 μm in place of 2.5 μm of Comparative Example 1, that the melting point of the film was lowered to 189° C. in place of 226° C. of Comparative Example 1, and that the size of the heating elements was made smaller to 25×33 μm in place of 30×40 μm of Comparative Example 1, with the applied energy changed correspondingly.

As a result, the volume of the resin that had existed at the place of each through hole decreased. Furthermore, the viscosity of the thick rim portions declined, to decrease the oblateness of each thick rim portion. Because of the foregoing, the width of each thick rim portion decreased. Furthermore, the value of formula (1) and the values of formulae (2x) and (2y) became positive and conformed to the requirement of this invention.

Comparative Example 2

A heat sensitive stencil sheet was processed into a stencil plate at a resolution of 300 dpi in the main scanning direction, at a resolution of 400 dpi in the sub scanning direction, with the target inner diameter of through holes as 59 μm in the main scanning direction and the target inner diameter of through holes as 44 μm in the sub scanning direction, and the stencil plate was used for printing.

As a result, the value of formula (1) and the values of formulae (2x) and (2y) became negative and did not conform to the requirement of this invention.

Example 4

A stencil plate was prepared and used for printing as described for Comparative Example 2, except that the thickness of the film was made thinner to 1.7 μm in place of 3 μm of Comparative Example 2, with the applied energy lowered correspondingly.

As a result, the volume of the resin that had existed in the place of each through hole decreased, and the width of each thick rim portion decreased. Furthermore, the value of formula (1) and the values of formulae (2x) and (2y) became positive and conformed to the requirement of this invention.

Comparative Example 3

A heat sensitive stencil sheet was processed into a stencil plate at resolutions of 600 dpi in both the main scanning direction and the sub scanning direction with the target inner diameters of through holes as 26 μm in both the main scanning direction and the sub scanning direction, and the stencil plate was used for printing.

As a result, the value of formula (1) and the values of formulae (2x) and (2y) became negative and did not conform to the requirement of this invention.

Example 5

A stencil plate was prepared and used for printing as described for Comparative Example 3, except that the thickness of the film was made thinner to 1.7 μm in place of 2.5 μm of Comparative Example 3, with the applied energy lowered correspondingly.

As a result, the volume of the resin that had existed in the place of each through hole decreased, and the width of each thick rim portion decreased. Furthermore, the value of formula (1) and the values of formulae (2x) and (2y) became positive and conformed to the requirement of this invention.

Example 6

A stencil plate was prepared and used for printing as described for Comparative Example 3, except that the melting point of the film was lowered to 189° C. in place of 226° C. of Comparative Example 3 and that the size of the heating elements was made smaller to 17×23 μm in place of 20×25 μm of Comparative Example 3, with the applied energy density raised.

As a result, while through holes with almost the same diameter were formed, the viscosity of the thick rim portions declined to decrease the oblateness of each thick rim portion, and the width of each thick rim portion decreased. Furthermore, the value of formula (1) and the values of formulae (2x) and (2y) became positive and conformed to the requirement of this invention.

Example 7

A stencil plate was prepared and used for printing as described for Comparative Example 3, except that the thickness of the film was made thinner to 1.7 μm in place of 2.5 μm of Comparative Example 3, that the melting point of the film was lowered to 189° C. in place of 226° C. of Comparative Example 3, and that the size of the heating elements was made smaller to 17×23 μm in place of 20×25 μm of Comparative Example 3, with the applied energy changed correspondingly.

As a result, the volume of the resin that had existed at the place of each through hole decreased. Furthermore, the viscosity of the thick rim portions declined, to decrease the oblateness of each thick rim portion. Because of the foregoing, the width of each thick rim portion decreased. Furthermore, the value of formula (1) and the values of formulae (2x) and (2y) became positive and conformed to the requirement of this invention.

TABLE 1

| | | | | Comparative Example 1 | Example 1 | Example 2 | Example 3 | Comparative Example 2 |
|---|---|---|---|---|---|---|---|---|
| Main scanning direction | Resolution | | dpi | 400 | 400 | 400 | 400 | 300 |
| | Pitch | $p_x$ | μm | 63.5 | 63.5 | 63.5 | 63.5 | 84.7 |
| | Diameter of through holes[1] | | μm | 43.8 | 43.6 | 44.4 | 43.4 | 58.3 |
| | Inner diameter of thick rim portions[1] | $d_x$ | μm | 45.5 | 45 | 45.7 | 44.6 | 60.2 |
| | Width of thick rim portions[1,2] | $f_x$ | μm | 14.3 | 9.2 | 11.4 | 7.8 | 18.5 |

TABLE 1-continued

| | | | | | | | | |
|---|---|---|---|---|---|---|---|---|
| Sub scanning direction | Resolution | | dpi | 400 | 400 | 400 | 400 | 400 |
| | Pitch | $p_y$ | μm | 63.5 | 63.5 | 63.5 | 63.5 | 63.5 |
| | Diameter of through holes[1] | | μm | 42.7 | 42.5 | 43.8 | 43.1 | 45.1 |
| | Inner diameter of thick rim portions[1] | $d_y$ | μm | 44.4 | 44 | 45.6 | 44.4 | 46.3 |
| | Width of thick rim portions[1,2] | $f_y$ | μm | 14.2 | 9 | 11.3 | 7.7 | 17.3 |
| Diagonal direction | Width of thick rim portions[1,3] | f | μm | 14.2 | 9.1 | 11.4 | 7.7 | 17.8 |
| Value of formula (1) | $p_x - (d_x + (\sqrt{2})\ f)$ | | | −2.1 | 5.6 | 1.7 | 8 | −0.7 |
| | $p_y - (d_y + (\sqrt{2})\ f)$ | | | −1 | 6.6 | 1.8 | 8.2 | −8 |
| Values of formulae (2x) and (2y) | $p_x - (d_x + (\sqrt{2})\ f_x)$ | | | −2.2 | 5.5 | 1.7 | 7.9 | −1.7 |
| | $p_y - (d_y + (\sqrt{2})\ f_y)$ | | | −1 | 6.8 | 1.9 | 8.2 | −7.3 |
| Stencil plate making conditions | Thickness of film | | μm | 2.5 | 1.7 | 2.5 | 1.7 | 3 |
| | Melting point of film | | ° C. | 226 | 226 | 189 | 189 | 226 |
| | Size of heating elements[4] | | μm | 30 × 40 | 30 × 40 | 25 × 33 | 25 × 33 | 45 × 45 |
| | Applied energy | | μJ | 60 | 48 | 44 | 40 | 82 |
| | Periods | | ms | 2.6 | 2.6 | 2.6 | 2.6 | 3 |
| Evaluation of perforations | SN ratio of areas of through holes | | db | 9.2 | 13.1 | 12.8 | 13.6 | 9.4 |
| Evaluation of prints | Uniformity of solid printed portions | | | X | ◎ | ○ | ◎ | X |
| | Blurring of fine characters | | | Δ | ◎ | ○ | ◎ | Δ |
| | Saturation of fine characters | | | Δ | ◎ | ○ | ◎ | X |
| | Set-off | | | X | ◎ | ◎ | ◎ | X |

| | | | | Example 4 | Comparative Example 3 | Example 5 | Example 6 | Example 7 |
|---|---|---|---|---|---|---|---|---|
| Main scanning direction | Resolution | | dpi | 300 | 600 | 600 | 600 | 600 |
| | Pitch | $p_x$ | μm | 84.7 | 42.3 | 42.3 | 42.3 | 42.3 |
| | Diameter of through holes[1] | | μm | 58.2 | 26.1 | 25.4 | 25.4 | 26.4 |
| | Inner diameter of thick rim portion[1] | $d_x$ | μm | 59.8 | 27.9 | 27.3 | 27.3 | 27.8 |
| | Width of thick rim portions[1,2] | $f_x$ | μm | 10.7 | 12.1 | 7.2 | 9.2 | 6.2 |
| Sub scanning direction | Resolution | | dpi | 400 | 600 | 600 | 600 | 600 |
| | Pitch | $p_y$ | μm | 63.5 | 42.3 | 42.3 | 42.3 | 42.3 |
| | Diameter of through holes[1] | | μm | 44.3 | 25.7 | 26.3 | 25.8 | 25.8 |
| | Inner diameter of thick rim portions[1] | $d_y$ | μm | 46.1 | 27.1 | 27.8 | 26.9 | 27.3 |
| | Width of thick rim portions[1,2] | $f_y$ | μm | 9.9 | 11.9 | 7.2 | 9.1 | 6 |
| Diagonal direction | Width of thick rim portions[1,3] | f | μm | 10.4 | 12 | 8.3 | 9.2 | 6.1 |
| Value of formula (1) | $p_x - (d_x + (\sqrt{2})\ f)$ | | | 10.2 | −2.6 | 3.3 | 2 | 5.9 |
| | $p_y - (d_y + (\sqrt{2})\ f)$ | | | 2.7 | −1.8 | 2.8 | 2.4 | 6.4 |
| Values of formulae (2x) and (2y) | $p_x - (d_x + (\sqrt{2})\ f_x)$ | | | 9.8 | −2.7 | 4.8 | 2 | 5.7 |
| | $p_y - (d_y + (\sqrt{2})\ f_y)$ | | | 3.4 | −1.6 | 4.3 | 2.5 | 6.5 |
| Stencil plate making conditions | Thickness of film | | μm | 1.7 | 2.5 | 1.7 | 2.5 | 1.7 |
| | Melting point of film | | ° C. | 226 | 226 | 226 | 189 | 189 |
| | Size of heating elements[4] | | μm | 45 × 45 | 20 × 25 | 20 × 25 | 17 × 23 | 17 × 23 |
| | Applied energy | | μJ | | | | | |
| | Periods | | ms | 68 | 32 | 26 | 24 | 21 |
| Evaluation of perforations | SN ratio of areas | | db | 3 | 2 | 2 | 2 | 2 |
| | of through holes | | | 13.3 | 8.8 | 12.1 | 11.7 | 13.2 |
| Evaluation of prints | Uniformity of solid printed portions | | | ◎ | X | ◎ | ○ | ◎ |
| | Blurring of fine characters | | | ◎ | X | ○ | ○ | ◎ |
| | Saturation of fine characters | | | ○ | ○ | ◎ | ◎ | ◎ |
| | Set-off | | | ○ | Δ | ◎ | ◎ | ◎ |

Note
[1]Mean value
Note
[2]Value on the side free from adjacent perforation
Note
[3]Value at the portion in the diagonal direction of arranged pixels in reference to the center of a perforation.
Note
[4]Main scanning direction x Sub scanning direction According to this invention, the heat shrinkable film of a heat sensitive stencil sheet used for stencil printing is perforated using a heating device such as a thermal head or laser beam to obtain a stencil plate which is provided with a perforation pattern that can inhibit the perforation configuration irregularity while keeping the size of perforations adequate since the perforations are formed with heat shrinkage without resorting to surface tension. Therefore, this invention can improve image quality of prints (e.g., decrease in density irregularity of solid printed portions, decrease in blurring and saturation of fine characters, and decrease of set-off and seep-through), and does not require a high temperature in the stencil plate making device, providing improvements in stencil plate making conditions (e.g., decrease of power consumption, shortening of stencil plate making time, and prevention of deterioration of heating elements).

What is claimed is:

1. A stencil plate which comprises a heat shrinkable film having independent dot perforations corresponding to an image, said perforations being formed by selectively heating said film with a heating device, wherein said perforations satisfy the following formula (1):

$$p \geqq d+(\sqrt{2}) \quad (1)$$

where p denotes a pitch between adjacent perforations in a direction; d denotes an inner diameter of said perforations in the same direction as p; and f denotes a width of rims of said perforations at a portion that is not merged with any rims of said adjacent perforations.

2. A stencil plate which comprises a heat shrinkable film having independent dot perforations corresponding to an image, said perforations being formed by selectively heating said film with a heating device, wherein said perforations satisfy the following formulae (2x) and (2y):

$$p_x \geqq d_x+(\sqrt{2})f_x \quad (2x)$$

$$p_y \geqq d_y+(\sqrt{2})f_x \quad (2y)$$

wherein $p_x$ and $p_y$ denote pitches between adjacent perforations in a first direction and a second direction orthogonal to the first direction respectively; $d_x$ and $d_y$ denote inner diameters of said perforations in the first direction and in the second direction respectively; and $f_x$ and $f_y$ denote widths of rims of said perforations at portions that are not merged with any rims of its said adjacent perforations and have normal lines in the first direction and the second direction respectively.

* * * * *